US011572772B2

(12) United States Patent
Pons

(10) Patent No.: US 11,572,772 B2
(45) Date of Patent: Feb. 7, 2023

(54) SYSTEM AND METHOD FOR EVALUATING RECIPROCATING DOWNHOLE PUMP DATA USING POLAR COORDINATE ANALYTICS

(71) Applicant: Ravdos Holdings Inc., New York, NY (US)

(72) Inventor: Victoria Pons, Houston, TX (US)

(73) Assignee: RAVDOS HOLDINGS INC., New York, NY (US)

( * ) Notice: Subject to any disclaimer, the term of this patent is extended or adjusted under 35 U.S.C. 154(b) by 267 days.

(21) Appl. No.: 16/748,750

(22) Filed: Jan. 21, 2020

(65) Prior Publication Data

US 2020/0232312 A1 Jul. 23, 2020

Related U.S. Application Data

(60) Provisional application No. 62/795,371, filed on Jan. 22, 2019.

(51) Int. Cl.
*E21B 43/12* (2006.01)
*E21B 47/009* (2012.01)
(Continued)

(52) U.S. Cl.
CPC ..... *E21B 43/127* (2013.01); *E21B 47/009* (2020.05); *F04B 49/065* (2013.01);
(Continued)

(58) Field of Classification Search
CPC ..... F04B 47/022; F04B 49/065; F04B 51/00; F04B 2201/121; F04B 2201/1211; F04B 2201/06; E21B 43/157; E21B 47/009
See application file for complete search history.

(56) References Cited

U.S. PATENT DOCUMENTS 4,015,469 A * 4/1977 Womack ..... E21B 47/007 73/152.61
5,064,349 A * 11/1991 Turner ..... F04B 49/02 417/44.1

(Continued)

FOREIGN PATENT DOCUMENTS

WO 2006102511 A1 9/2006

OTHER PUBLICATIONS

International Search Report and Written Opinion issued in connection with corresponding PCT Application No. PCT/US2020/14483 dated Apr. 9, 2020.

*Primary Examiner* — Charles G Freay
(74) *Attorney, Agent, or Firm* — Dentons Cohen & Grigsby P.C.

(57) ABSTRACT

A method for evaluating data from a reciprocating downhole pump includes the steps of acquiring downhole position and load data, providing the position and load data to a processing unit, normalizing the position and load data, converting the position and load data to a calculated polar coordinate data set, evaluating the calculated polar coordinate data set to determine a condition or occurrence at the reciprocating pump, and outputting calculated key parameters for controlling and optimizing the reciprocating pump and beam pumping unit. The method further comprises a step of creating a library of reference data sets, comparing the calculated polar data set against the library of ideal and reference data sets, identifying one or more reference data sets that match one or more portions of the calculated polar data set, and outputting the probability of one or more of the known conditions within the calculated polar data set.

16 Claims, 14 Drawing Sheets

(51) Int. Cl.
*F04B 51/00* (2006.01)
*F04B 49/06* (2006.01)
*F04B 47/02* (2006.01)

(52) U.S. Cl.
CPC ..... *F04B 51/00* (2013.01); *F04B 47/022* (2013.01); *F04B 2201/06* (2013.01); *F04B 2201/121* (2013.01); *F04B 2201/1211* (2013.01)

(56) References Cited

U.S. PATENT DOCUMENTS

| | | | | |
|---|---|---|---|---|
| 5,370,538 | A | 12/1994 | Sidray | |
| 6,599,095 | B1 * | 7/2003 | Takada | F04B 49/065 417/42 |
| 6,857,474 | B2 * | 2/2005 | Bramlett | E21B 47/009 417/63 |
| 8,328,527 | B2 | 12/2012 | Ehimeakhe | |
| 9,033,676 | B2 | 5/2015 | Palka et al. | |
| 9,810,212 | B2 | 11/2017 | Pons | |
| 9,810,214 | B2 * | 11/2017 | Pons | F04B 49/20 |
| 10,145,230 | B2 * | 12/2018 | DaCunha | F04B 49/065 |
| 10,774,627 | B1 * | 9/2020 | Lea, Jr. | E21B 47/009 |
| 10,815,770 | B2 * | 10/2020 | Moreno | E21B 43/127 |
| 2011/0091332 | A1 | 4/2011 | Ehimeakhe | |
| 2011/0091335 | A1 | 4/2011 | Ehimeakhe | |
| 2016/0273346 | A1 | 9/2016 | Tang et al. | |
| 2017/0016313 | A1 | 1/2017 | Pons et al. | |
| 2017/0235284 | A1 * | 8/2017 | Watson | G05B 23/0297 700/31 |
| 2020/0191136 | A1 * | 6/2020 | Hoefel | F04B 47/026 |

* cited by examiner

SYSTEM AND METHOD FOR EVALUATING RECIPROCATING DOWNHOLE PUMP DATA USING POLAR COORDINATE ANALYTICS

RELATED APPLICATIONS

This application claims the benefit of U.S. Provisional Patent Application Ser. No. 62/795,371 filed Jan. 22, 2019, entitled "System and Method for Evaluating Reciprocating Downhole Pump Data Using Polar Coordinate Analytics," the disclosure of which is herein incorporated by reference.

FIELD OF THE INVENTION

This invention relates generally to oilfield equipment and in particular to a system and method for evaluating the performance and improving control and optimization of reciprocating rod lift installations.

BACKGROUND

Hydrocarbons are produced from wells, which will eventually be assisted with artificial lift systems. Rod lift pumping systems, which are sometimes referred to as "walking-beam pump systems" or "beam pumping units," recover wellbore fluids with a reciprocating downhole plunger that is connected to a surface pumping unit by a rod string. A number of factors complicate the evaluation of the performance, control and optimization of reciprocating rod lift installations, such as elasticity of the rod string and friction of both viscous and mechanical nature.

Often, the pumping system is capable of removing liquid from the wellbore at a rate that exceeds the rate of fluid entering the wellbore. When the level of fluid in the wellbore drops to an extent at which the downhole pump no longer fills between reciprocating pump strokes, the well can be characterized as "pumped off" and exhibit a condition referred to as "fluid pound," in which the reciprocating plunger contacts the fluid column at higher velocities. Fluid pound is undesirable because it introduces stresses on equipment and is symptomatic of reduced pump fillage caused by an undesirable liquid level in the well. Remedial control efforts can be undertaken to reduce fluid pound and improve pump fillage such as slowing down or stopping the pumping unit for a specified amount of time.

For many years, the performance and control of reciprocating rod lift installations was estimated using information gathered at the surface. Pump position and load data were measured and recorded using surface-based sensors. From the surface position and load data, downhole position and load data can be calculated using the one-dimensional wave equation. The position and load data over a pump cycle can be charted to a graphical representation referred to as "dynamometer card." The term "pump card" illustrates the same graphical representation when it is applied to downhole data. Based on the pump card and reference (or ideal) cards, the operator can attempt to evaluate the performance of the pump and identify potential problems downhole. The pump card is very useful. Its shape, horizontal span and vertical span reveal defective pumps, completely filled pumps, gassy or pounding wells, unanchored tubing, parted rods, etc. The pump card can also be used to compute producing pressure, liquid and gas throughput, and oil shrinkage effects. It can also be used to sense tubing leaks.

Although widely adopted, the reliance on modern surface dynamometer cards presents several concerns. The wide variations of surface dynamometer cards may frustrate efforts to accurately measure performance or diagnose a problem downhole. The comparison of surface dynamometer cards can be subjective and trained operators may reach very different conclusions based on interpretations of the same graphical data or not identify potential downhole problems.

Since the use of the one-dimensional wave equation was validated as a means to calculate downhole data from surface data, it has been common practice in the oil and gas industry to analyze downhole dynamometer cards or pump cards instead of relying on surface data alone. Downhole pump card can also be compared to ideal pump cards identifying one or more downhole conditions. Analyzing downhole dynamometer cards, or pump cards, involves computing key control parameters to assess efficiency and improve control of the reciprocating rod lift installation. However, the time consuming practice of reading pump cards may prevent operators from effectively monitoring and controlling large numbers of wells. Accordingly, there is a need for an improved system of evaluating and improving the efficiency of the overall system and control of reciprocating rod lift installations that overcomes the deficiencies of the prior art. It is to these and other deficiencies in the prior art that the present invention is directed.

SUMMARY OF THE INVENTION

A method for evaluating data from a reciprocating downhole pump includes the steps of acquiring downhole position and load data, providing the position and load data to a processing unit, normalizing the position and load data, converting the position and load data to a calculated polar coordinate data set, evaluating the calculated polar coordinate data set to determine a condition or occurrence at the reciprocating pump, and outputting a diagnosis for downhole conditions present as well as calculated key control parameters. In some aspects, the method further comprises a step of creating a library of reference data sets based on measurements taken from the well, wherein the reference data sets are presented in polar coordinates and wherein each of the reference data sets corresponds to a known condition for the reciprocating pump, comparing the calculated polar data set against the library of predetermined ideal data sets and reference data sets, identifying one or more reference or ideal data sets that match one or more portions of the calculated polar data set, and outputting one or more statements regarding the probability of the presence of one or more of the known conditions within the calculated polar data set.

WRITTEN DESCRIPTION

Figure 1:
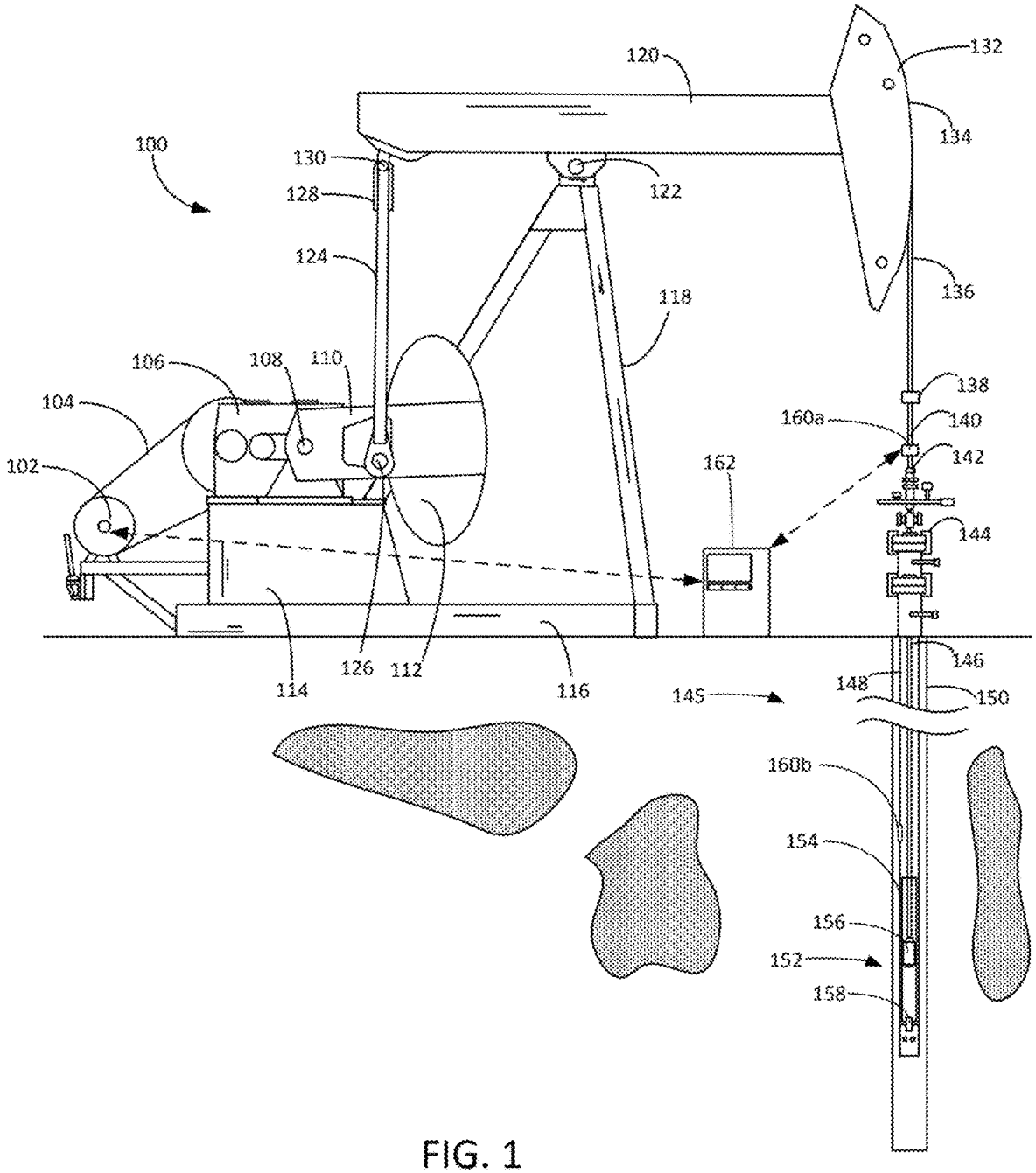
FIG. 1 is a side view of a beam pumping unit and well head.

FIG. 1 shows a beam pumping unit 100 constructed in accordance with an exemplary embodiment of the present invention. The beam pumping unit 100 is driven by a prime mover 102, typically an electric motor or internal combustion engine. The rotational power output from the prime mover 102 is transmitted by a drive belt 104 to a gearbox 106. The gearbox 106 provides low-speed, high-torque rotation of a crankshaft 108. Each end of the crankshaft 108 (only one is visible in FIG. 1) carries a crank arm 110 and a counterbalance weight 112. The reducer gearbox 106 sits atop a sub-base or pedestal 114, which provides clearance for the crank arms 110 and counterbalance weights 112 to rotate. The gearbox pedestal 114 is mounted atop a base 116. The base 116 also supports a Samson post 118. The top of the Samson post 118 acts as a fulcrum that pivotally supports a walking beam 120 via a center bearing assembly 122.

Each crank arm 110 is pivotally connected to a pitman arm 124 by a crank pin bearing assembly 126. The two pitman arms 124 are connected to an equalizer bar 128, and the equalizer bar 128 is pivotally connected to the rear end of the walking beam 120 by an equalizer bearing assembly 130, commonly referred to as a tail bearing assembly. A horse head 132 with an arcuate forward face 134 is mounted to the forward end of the walking beam 120. The face 134 of the horse head 132 interfaces with a flexible wire rope bridle 136. At its lower end, the bridle 136 terminates with a carrier bar 138, upon which a polish rod 140 is suspended.

The polish rod 140 extends through a packing gland or stuffing box 142 on a wellhead 144 above a well 145. A rod string 146 of sucker rods hangs from the polish rod 140 within a tubing string 148 located within a well casing 150. The rod string 146 is connected to the plunger and traveling valve of a subsurface rod pump 152. In a reciprocating cycle of the beam pump unit 100, well fluids are lifted within the tubing string 148 during the rod string 146 upstroke. The rod pump 152 includes a pump barrel 154, a traveling valve 156 and a standing valve 158.

In a reciprocating cycle of the rod pump 152, fluids from the well 145 are lifted within the tubing string 148 during the rod string 146 upstroke. In accordance with well-established rod lift pump design, the stationary standing valve 158 opens and the traveling valve 156 closes near the bottom of the pump stroke, as the traveling valve 156 begins to move upward. As the standing valve 158 opens, fluid from within the well casing 150 enters the pump barrel 154. As the traveling valve 156 nears the top of the stroke, the standing valve 158 closes, preventing fluid in the pump barrel 154 from draining back into the well casing 150. As the traveling valve 156 returns toward the standing valve 158, the traveling valve 156 opens to allow fluid in the pump barrel 154 to pass through the traveling valve 156. Once the rod pump 152 begins the next cycle, the traveling valve 156 closes to lift the fluid above the traveling valve 156 through the tubing string 148.

The pump 100 also includes a sensor module 160 that measures load on the rod string 146 and the position of the rod string 146. The sensor module 160 may also be configured to measure additional conditions within the well and pump 100. The sensor module 160 may be positioned at or near the wellhead 144 (as shown at 160*a*), downhole near the rod pump 152 (as shown at 160*b*), or in multiple locations on the surface and downhole. The sensor module 160 is configured to output load and position measurements to a processing unit 162.

The processing unit 162 may be located near the beam pumping unit 100 (as shown) or at a remote location. Depending on where the processing unit 162 is located, the signal from sensor module 160 may be provided to the processing unit 162 through a direct wired local connection, a wireless local connection, a distributed network, or through an extended telecommunications or data network. In exemplary embodiments, the processing unit 162 is a computer that is configured to operate computer programs. The processing unit 162 may include standard human interface devices such as a display, keyboard and printer. It will be appreciated that in some embodiments, the processing unit 162 is distributed between multiple locations such that the computer program and processing take place at one or more remote locations and the various outputs from the processing unit 162 are presented in one or more locations.

Figure 2:
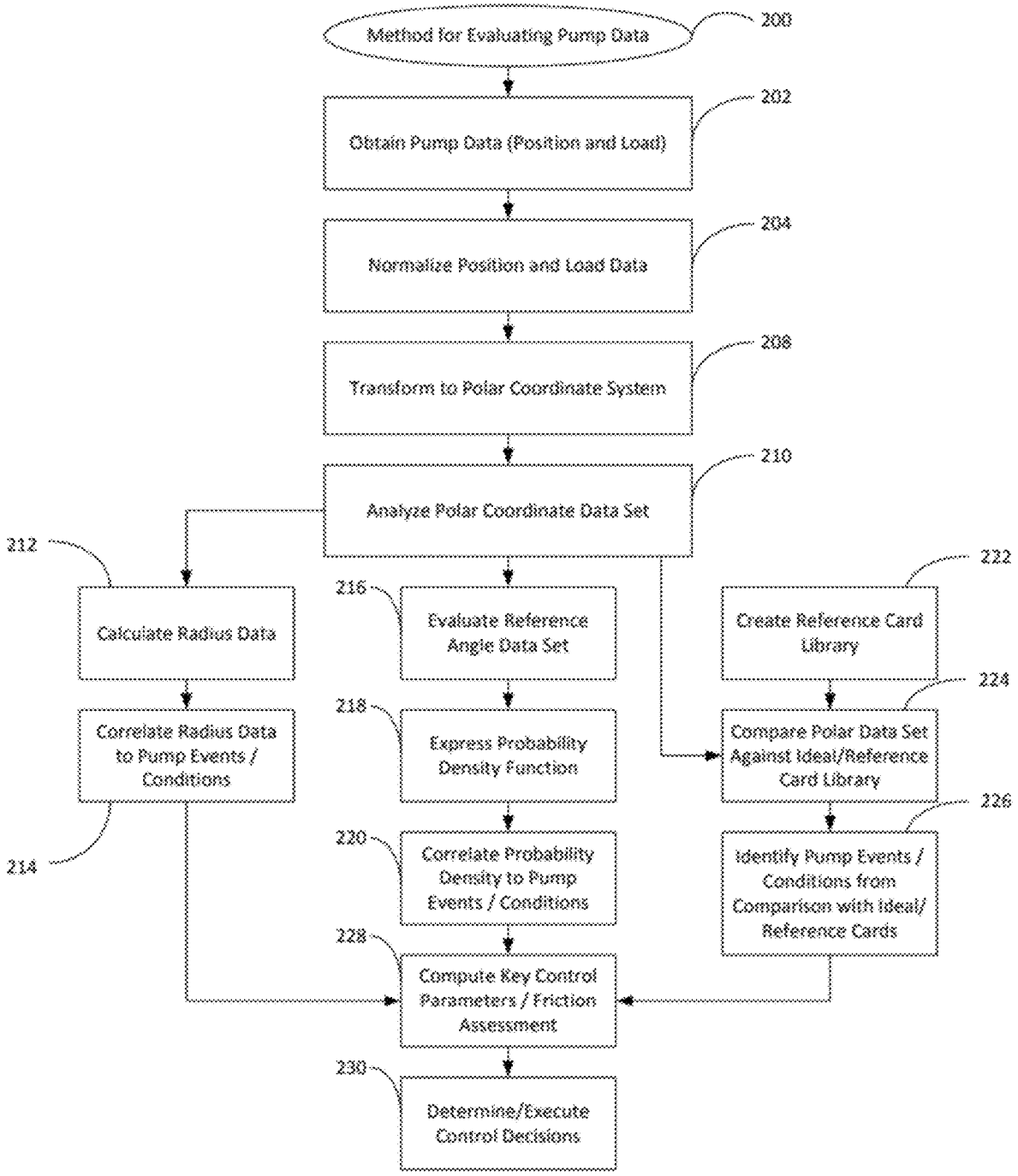
FIG. 2 is a process flow diagram for a method of evaluating pump data.

Turning to FIG. 2, shown therein is a process flow chart for a method 200 of evaluating data obtained from the sensor module 160. The method 200 can be carried out as computer programming by the processing unit 162. Generally, the method 200 is used to calculate control parameters, assess presence of viscous and mechanical friction, estimate efficiency of the reciprocating rod pump 152 installation, and determine downhole conditions present for the rod pump 152 by extracting information from the load and position data provided by the sensor module 160. The output from the method 200 can be used by an operator to adjust the operation of the beam pumping unit 100, to determine production rates from the well 145, or to identify problems or adverse conditions in the well 145.

For example, in exemplary embodiments, the output from the method 200 can be used to automatically determine a number of important control parameters including, but not limited to, net stroke, fluid load, pump fillage, standing valve opening and closing, traveling valve opening and closing, pump horsepower, and friction assessment. Pump fillage is an important quantity to monitor because it may alert the operator to a loss or production and may signal impending equipment damage. Fluid load and related fluid load lines are essential in excess friction detection, and validation of viscous damping forces present in the well. Along with the netstroke, fluid load can be used to determine a number of quantitative and qualitative performance factors, including inferred production, volumetric displacement, efficiency, fluid level.

Identifying the occurrence of the standing valve opening (SVO) is essential when investigating unanchored tubing and rod stretch as well as identifying conditions such as worn traveling valve or delayed valve opening. During gas interference, for example, the top left corner of the downhole card will be rounded and the location of the SVO shifted to the right. This shifted distance represents the un-swept plunger distance due to gas expansion. Standing valve closing (SVC), which typically occurs at the top of stroke (TOS), can help calculate pump intake pressure (PIP) and detect the presence of extra friction as well as downhole conditions such as worn traveling valve or a split barrel. The determination of the traveling valve opening (TVO) event can be used to help calculate pump discharge pressure (PDP).

As mentioned above, during reciprocating rod lift operations, energy is continuously and irreversibly lost due to friction. This friction can be viscous in nature or mechanical. Viscous friction arises from the productions fluids imparting a viscous force on the outer surface area of the rod string impeding its movement. Energy can be removed from the wave equation using the damping term to mimic the effects of the energy lost to viscous friction during the pumping cycle. Failure to properly estimate and compensate for the viscous friction forces will result in inaccurate downhole data.

The method 200 can also be used to automatically identify adverse conditions or equipment failures, including fluid pound, pump off, tubing movement, gas interference, inoperative pump, pump contact/tapping, bent pump barrel, sticking pump, worn plunger or traveling valve, worn standing valve, damaged or worn pump barrel, and paraffin accumulation.

Generally, the method 200 includes a process for converting normalized position and load data into a data set of polar coordinates represented by radii and reference angles. The polar coordinate data set can be evaluated using various algorithms to compute control parameters, identify downhole conditions present during pumping, and recognize the timing of events of the pump cycle. The polar coordinate data set can also be used as the basis for a comparison against a library of ideal or reference data sets that have likewise been converted to polar coordinates. The method 200 can be performed automatically within the processing unit 162 or in response to commands from an operator controlling the processing unit 162. The output from the method 200 can be presented to an operator as a report, or provided by the processing unit 162 to the beam pumping unit 100 to enable autonomous control of the beam pumping unit 100.

The method 200 begins at step 202 as live position and load data from the operating beam pumping unit 100 is provided by the sensor module 160 to the processing unit 162. The position data can be expressed in units of distance (e.g., inches of travel). The load data can be expressed in units of force or weight (e.g., lbs). The position and load data is provided to the processing unit 162 according to a preset sampling rate during the cycle of the rod pump 152. In exemplary embodiments, the data corresponding to each pump cycle is stored as a unique data set within the processing unit 162. Downhole position and load data is calculated from surface position and load data using the one-dimensional wave equation with traditional techniques such as separation of variables or finite differences.

At step 204, the downhole load and position data is normalized by dividing each discrete measurement by the span of measurements. When normalized, each discrete measurement is essentially represented as a percentage of the maximum value measured during the pump cycle. The normalized load and position values range from 0 to 1.

Figure 3:
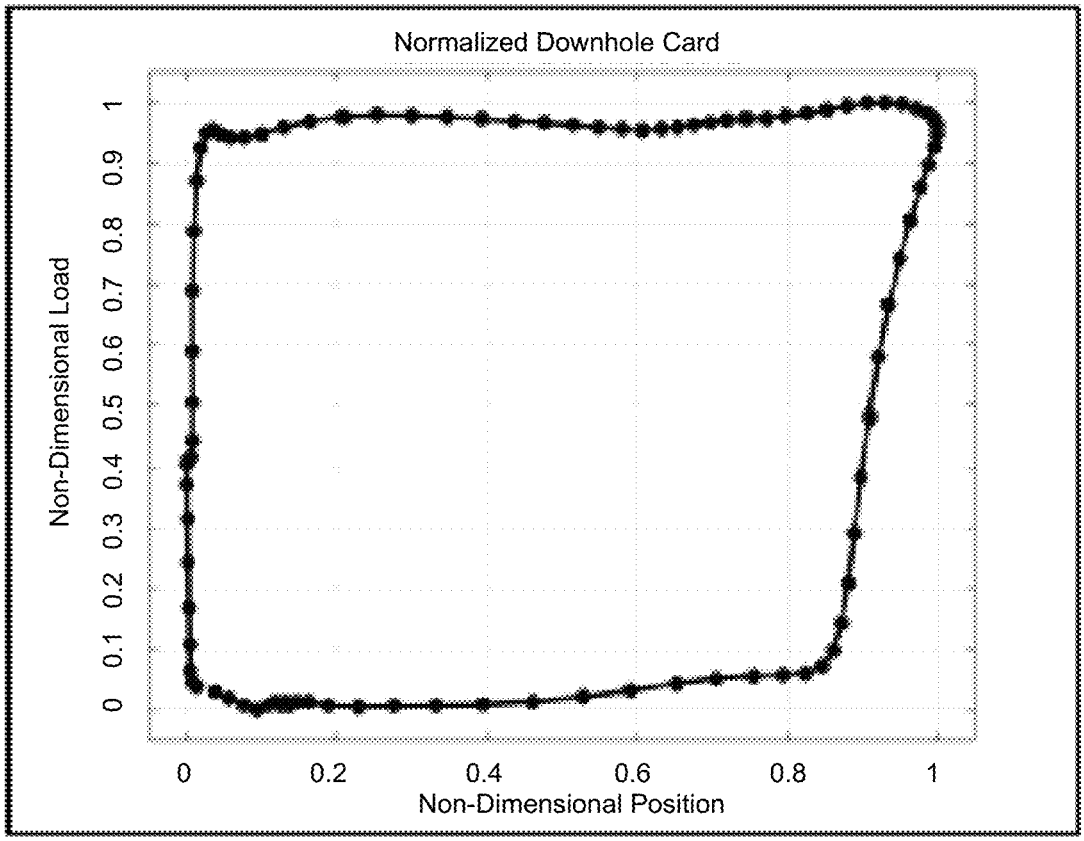
FIG. 3 is a normalized, dimensionless downhole card showing load against position.

For example, the normalized load and position values can be determined with calculations in which P(x) denotes downhole position data and L(x) denotes downhole load data. To normalize the data, the position and load data are divided by their respective spans. This creates normalized position and load data sets ranging from [0, 1], as shown in FIG. 3.

$$\text{For } i = 1, \ldots, N:$$

$$NP(x) = \frac{P(x)}{R_P}, \text{ and } NL(x) = \frac{L(x)}{R_L}.$$

where NP(x) are the normalized positions, NL(x) are the normalized loads, $R_P$ is the range of position data, and $R_L$ is the range of load data.

Figure 4:
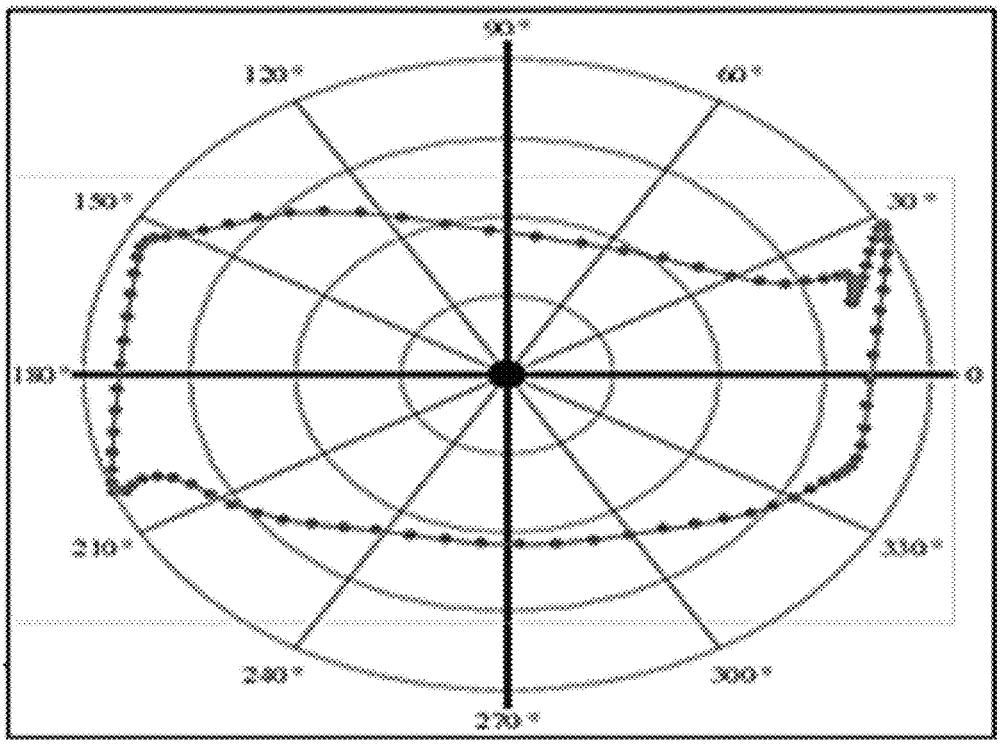
FIG. 4 is provides a graphical representation of normalized load and position data superimposed on a polar coordinate system.
Figure 5:
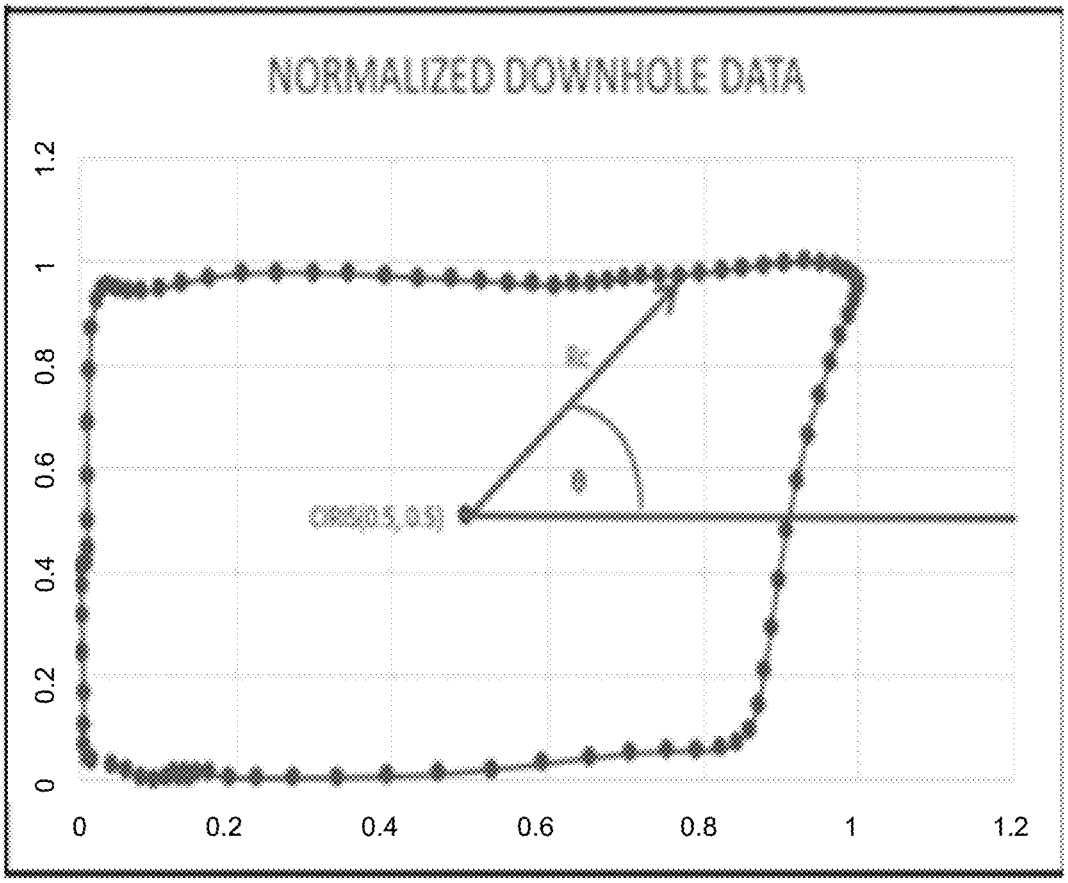
FIG. 5 presents a graphical representation of the definition of a polar coordinate system on the position and load data of FIG. 3.
Figure 6:
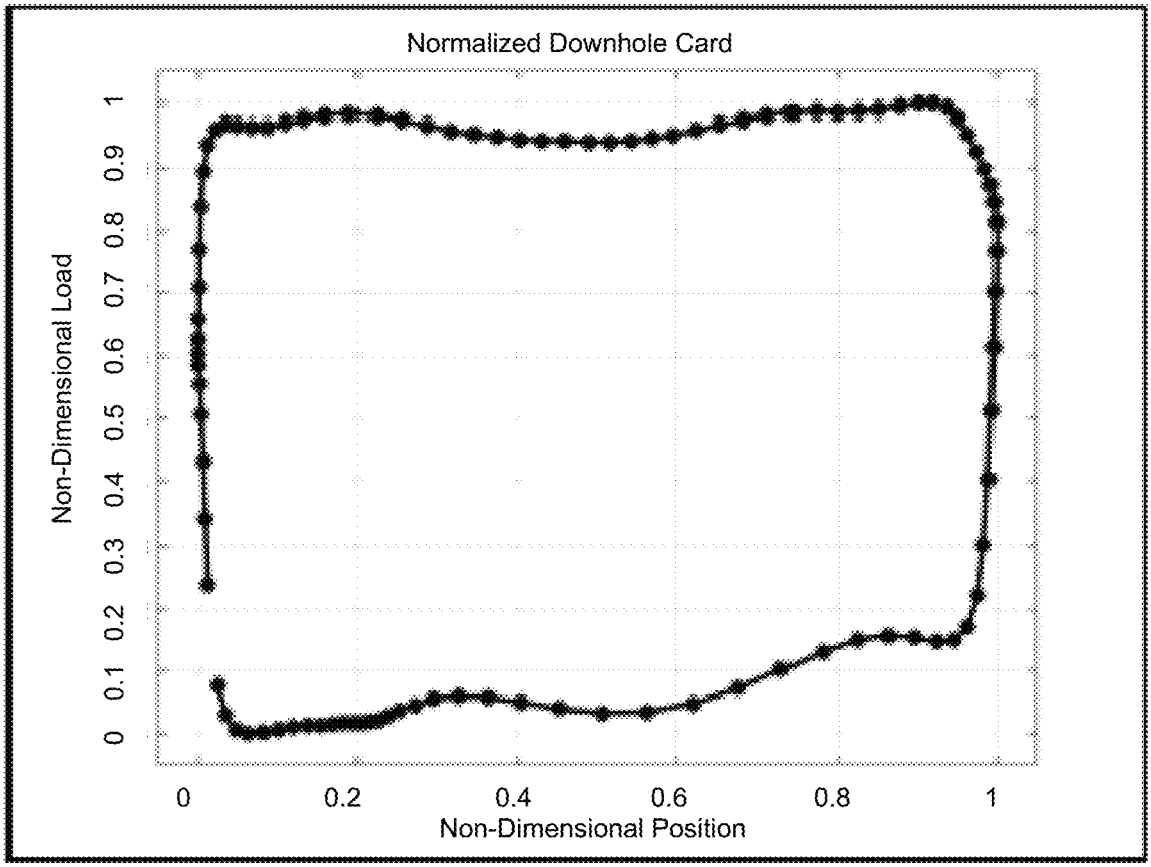
FIG. 6 presents a sample pump card showing normalized position and load data.
Figure 7:
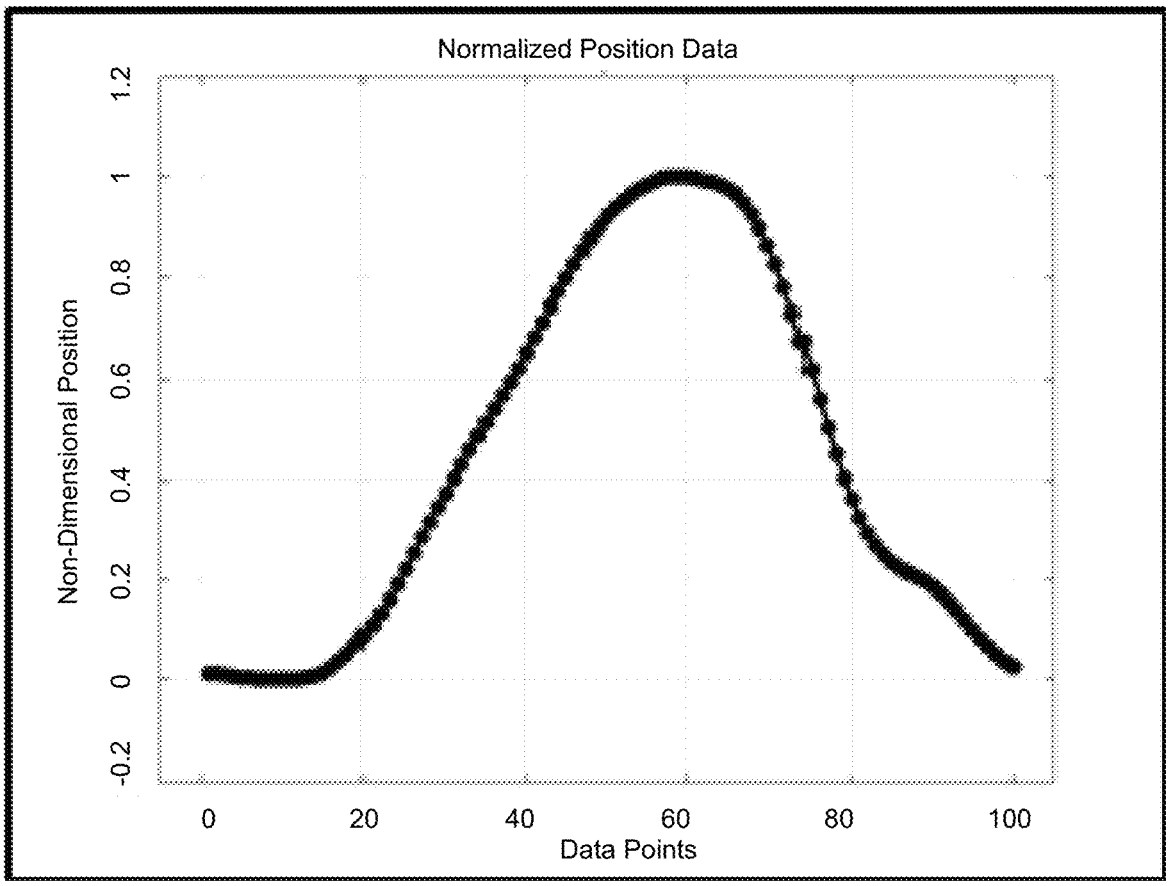
FIG. 7 presents a graphical representation of the normalized position data over the course of one pump cycle.

At step 208, the processing unit 162 transforms the normalized position and load data into polar coordinates, as depicted in FIGS. 4 and 5. FIG. 4 presents an example normalized data set superimposed over a polar coordinate system, where the center of the polar coordinate system is placed at the center of the graph of the normalized load and position data. FIG. 5 illustrates the definition of the polar coordinate system from the center of the normalized position and load data from FIG. 3.

In the example given in FIG. 5, the processing unit 162 assigns the center (pole) of the polar coordinate system at (0.5, 0.5) within the normalized data set. Every point of the normalized data set is shifted to have (0.5, 0.5) as the center of the new coordinate system.

$$\forall(x,y) \ni x \in P(x) \& y \in L(x),$$

$$P_{IRIS} = (x - 0.5 \cdot y - 0.5).$$

Polar coordinates describe points in space using a radius and a reference angle to the origin. The radius data is taken to be the distance between the normalized point and the origin, while the reference angle is the angle in radians or degrees between the normalized shifted point and the horizontal line y=0.5 passing through the coordinate system origin (0.5, 0.5) as seen in FIG. 5.

The radius is calculated using the traditional distance formula:

$$R_C = \sqrt{(x-0.5)^2 + (y-0.5)^2}.$$

The reference angle is calculated using:

$$\theta_C = \tan^{-1}\frac{y}{x}.$$

Once the polar coordinate system transformation has been applied to the normalized data set, each data point can be expressed and analyzed as a pair of polar coordinates at step 210. In this way, the processing unit 162 quickly converts the normalized position and load data from a Cartesian coordinate system to the polar coordinate system. Converting the position and load data to a polar coordinate system and placing the center (pole) of the polar coordinate system at the center of the graph of the position and load data facilitates the automated extraction of valuable information from the data set, as explained below.

Figure 8:
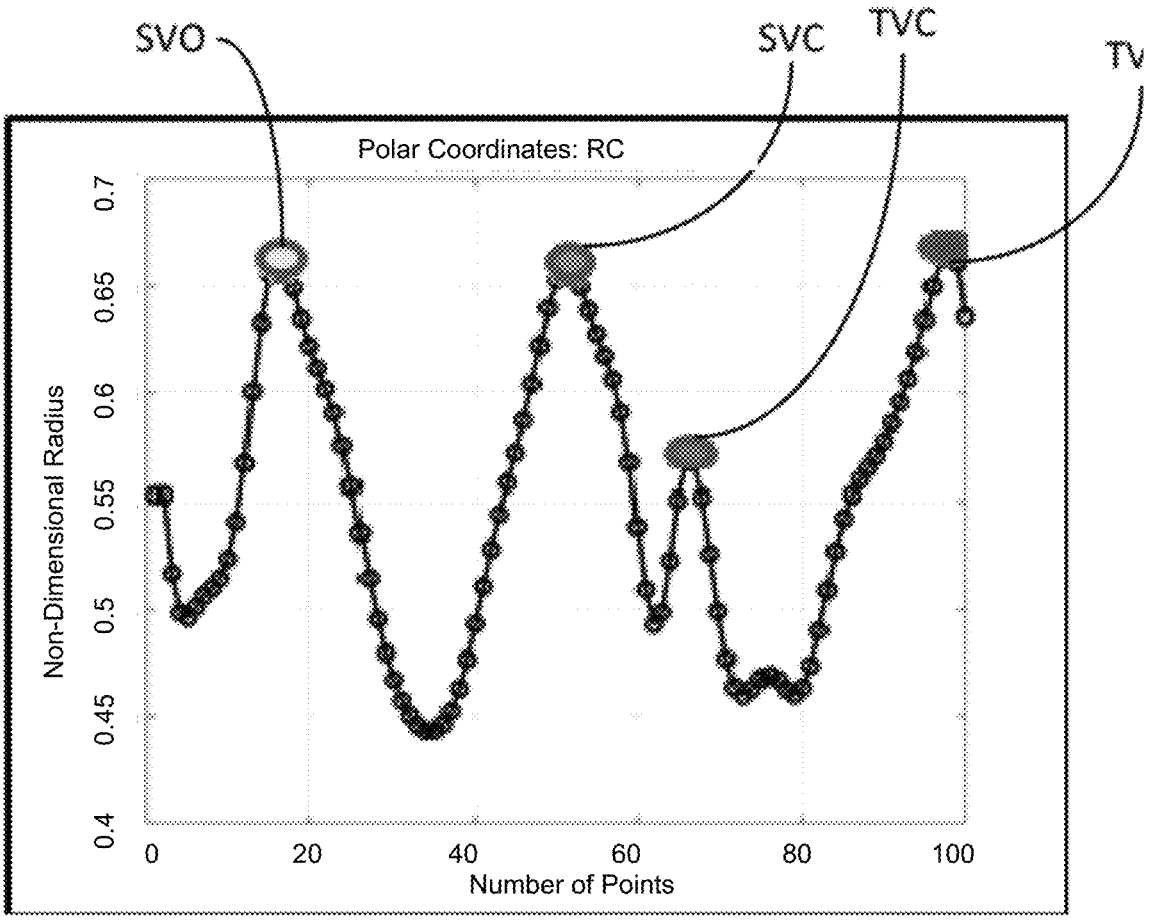
FIG. 8 presents a graphical representation of the distribution of the radius data set over the course of one pump cycle showing some of the various events determined by analyzing the radius data set.

In one aspect as set forth in steps 212 and 214, the radius data set is analyzed to determine various conditions or events occurring downhole. For example, the radius data set can be analyzed to identify standing valve opening (SVO) and closing (SVC), traveling valve opening (TVO) and closing (TVC), top of stroke (TOS) and pump fillage (PF). As illustrated in FIG. 8, the local and absolute maximums of the radius data set correspond to the valve openings (SVO, TVO) and closings (SVC, TVC).

For a downhole dynamometer card depicting a full pump, the four sides and four corners of the card correspond to the absolute and local minimum and maximum of the radius data set respectively. By computing the first derivative of the radius data set and finding the critical points, the locations of the valve opening and closing events can be automatically determined by the processing unit 162. Additionally, computing the second derivative of the radius data set and finding points of inflection allows for an accurate way for automatically identifying the key events on the downhole card.

Figure 9:
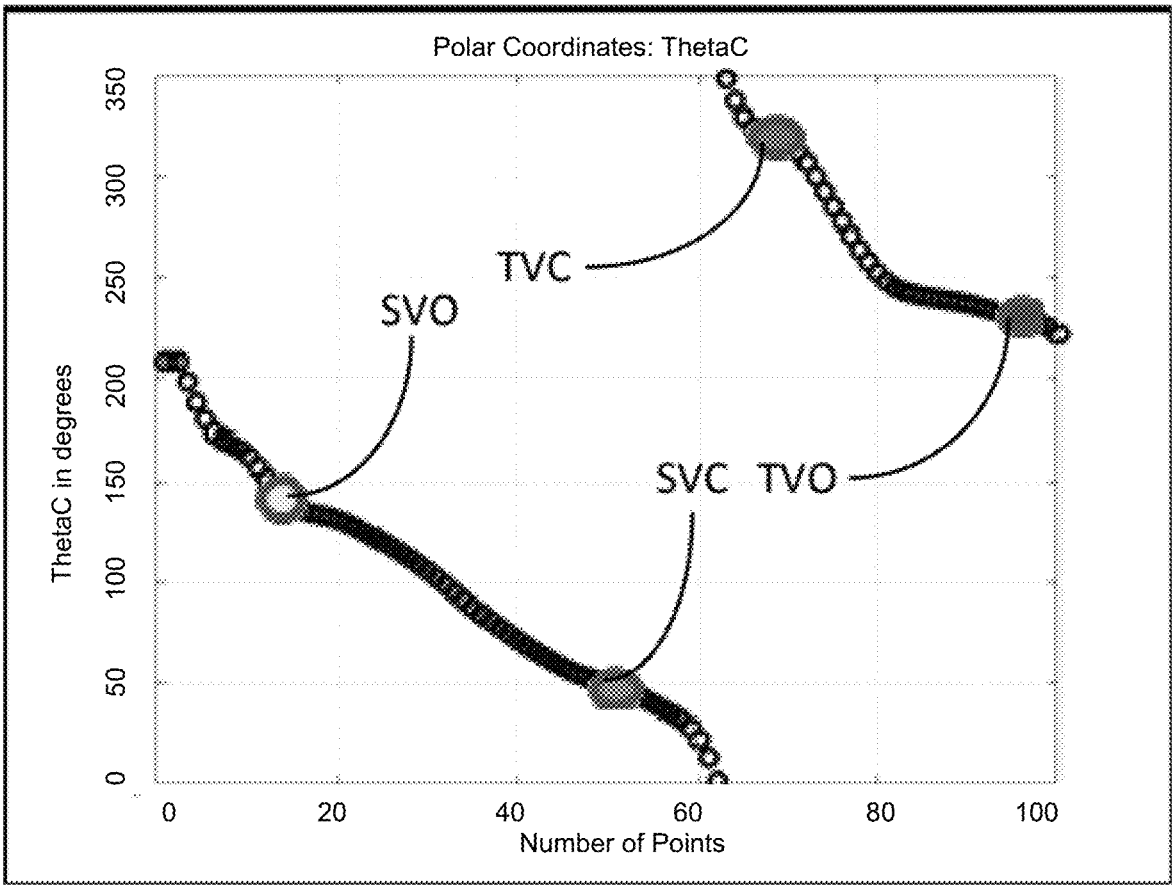
FIG. 9 presents a graphical representation of the distribution of the reference angle data set over the course of one pump cycle showing some of the various events determined by analyzing the radius data set.

The first and second derivatives can be calculated using traditional methods for discrete data sets. For example, with $R_C(x)$ denoting the radius data set, critical points for the radius data can be calculated by solving $R_C''(x)=0$. Inflection points can be calculated by solving $R_C''(x)=0$. For each critical point, if $R_C'(x)$ changes from positive to negative, then $R_C(x)$ has a local maximum. If $R_C'(x)$ changes from negative to positive, then $R_C(x)$ has a local minimum. If $R_C''(x)<0$, then the function $R_C(x)$ is concave down, whereas if changes from positive to negative, then $R_C(x)$ has a local maximum. These calculations and determinations can be made by the processing unit 162 without human intervention at step 212. Once the maximums have been calculated and the coordinates identified for each event at step 214, the corresponding reference angle can be determined as indicated in FIG. 9.

In another aspect, the reference angle data set is evaluated by the processing unit 162 at steps 216, 218 and 220 to further identify downhole conditions at the rod pump 152. At step 216, the reference angle data set is evaluated to determine valve opening and closing events at the rod pump 152. Generally, reference angles belonging to [150°, 200°] correspond to the rod string 146 stretching as it is lifted by the beam pumping unit 100 on the upstroke. Reference angles belonging to [30°, 150°] correspond to the part of the upstroke when the traveling valve 156 moves up. Reference angles belonging to [340°, 30°] correspond to the rod string 146 compressed back to its original state during the downstroke, while reference angles belonging to [210°, 330°] correspond to the rest of the downstroke as the traveling valve 156 moves back to its original position as seen in FIG. 4.

The reference angle data set also enables the analysis of data on a per-sector basis. The polar data set can be analyzed sector by sector with increments as small as 1°. The reference angle data set allows for the data to be parted by specific events as explained above. For example, the absence of data points for reference angles [270°, 360°] indicates more than 50% pump off in the well 145. The radius and reference angle data set can therefore help guide the calculation of key parameters, which would be difficult to find mathematically using standard approaches based on the dampened wave equation.

In another aspect, the reference angle data set is used to create a probability density function at step 218 to examine the point distribution per angle sector. The polar coordinate sets can be sorted by any angle increment (e.g., $\theta_S$=5°, 10°, 15° . . . ) for coarser (FIG. 10) or finer (FIG. 11) results. The sorted points can now create a probability density function, which accentuates the areas of the polar coordinate set having the highest point concentrations. When there is an accumulation of points in the downhole data, this indicates that there the rod string 146 slowed down at that particular point of the stroke. This slowing down phenomenon can be attributed to normal pumping operations, i.e. the beam pumping unit 100 will slow down at the top of stroke and at the bottom of stroke as well as slightly slow down after the rod string 146 is stretched and after the rod string 164 is compressed back into its normal size.

In other cases, the accumulation of points can also be attributed to a wellbore event such as a moderate to severe dog leg in the well 145 that creates mechanical friction on the rod string 146. Using the probability density function at step 220, the position of the slowing down relative to rod stretch can pin point the exact location of where the rod string is "sticking" or slowing down or stopping momentarily. Using that information, the processing unit 162 can calculate the depth of the event using the coefficient of rod stretch:

$$K_r = \frac{AE}{L}.$$

Where Kr is the coefficient of rod stretch, A is the area of the rod, E is Young's modulus of elasticity for the rod, and L is the length of the rod.

Thus, the reference angle data set can be used to identify downhole events and provide the basis for understanding the effects of deviation on the rod string 146 and the different sources of extra friction and their impact on the operation of the beam pumping unit 100.

In another significant aspect, the method 200 includes analytical routines utilizing the polar coordinate conversion for comparing reference cards or ideal cards against actual measurements made by the sensor module 160. As used herein, the term "ideal cards" refers to data sets based on shape cards that correspond to established downhole conditions and events. The ideal cards are preloaded into the processing unit 162 and are not based on measurements taken at the well 145. In contrast, "reference cards" refers to data sets derived from pump cards and measurements taken at the well 145 and stored as historic records within the processing unit 162. At step 222, a reference card library is created by storing previous polar data sets that have been obtained through steps 204-210. The ideal cards and reference cards can be used to create polar coordinate data sets for a variety of reference conditions, including fluid pound, pump off, tubing movement, gas interference, inoperative pump, pump contact/tapping, bent pump barrel, sticking pump, worn plunger or traveling valve, worn standing valve, damaged or worn pump barrel, and paraffin accumulation.

At step 224, the processing unit 162 compares the polar coordinate data set from the actual calculated downhole data against the ideal/reference polar coordinate data sets library produced at step 222. This comparison can include comparing trends of the calculated radius data set against the reference data set stored in the library. The reference angle data set can also be compared to give insight on the downhole condition present. It will be appreciated that the reference card library can be created and stored in the processing unit 162 at step 222 long before the actual measurements are made with the sensor module 160.

Using the newly created data sets i.e. the radius, reference angle and corresponding probability density functions, the current data sets can be compared against reference data sets either on a card-by-card or sector-by-sector basis. Least squares and other comparative mathematical techniques can be used to assess the degree of compatibility between the current data and ideal data using:

$$E(x)=\Sigma[R_{C_current}-R_{C_ideal}]^2.$$

Where E(x) is the error from the least squares analysis, $R_{C\text{-}current}$ is the radius data set derived from the measurements made by the sensor module 160, and $R_{C\text{-}ideal}$ is the radius data set from the reference library.

Using these comparative techniques, at step 226 the processing unit 162 matches portions of the current polar coordinate data set with one or more ideal or reference data sets to diagnose conditions present downhole based on similarities identified with the reference data sets. In some embodiments, the processing unit 162 outputs multiple potential diagnoses based on probable matches between the calculated data set and the reference data set. For example, for any particular sector, the behavior of the current card can be compared using the above data set to an entire library of ideal card capable of returning a percentage of certainty for certain downhole conditions to be present. This enables the diagnosis of multiple downhole conditions in the same card. Based on operator feedback to these multiple diagnoses, the processing unit 162 can be configured to discount potential matches in the future that are discarded by the operator. In this way, the deployment of the method 200 by the processing unit 162 includes an autonomous self-learning function that will improve the accuracy of the actual-reference match over time.

At step 228, results from steps 214, 220 and 226 can be used to compute key control parameters, which enable reciprocating rod lift control and optimization decision making in step 230. In some embodiments, the output from step 230 is provided from the processing unit 162 directly to the prime mover 102 (or its controller) to automatically adjust the operation of the beam pumping unit 100. In other embodiments, the output from step 230 is provided from the processing unit 162 as a report configured for human interpretation to allow the operator to adjust the operation of the beam pumping unit 100.

The method 200 can also be used at step 228 to evaluate frictional losses within the beam pumping unit 100 system. Using the calculated valve opening and closing events, the fluid load lines $F0_{down}$ and $F0_{up}$ can be computed. The area between the top of downhole card and $F0_{up}$ as well as the area between the bottom of the card and $F0_{down}$ are computed using Riemann sums. The equation for the upstroke and downstroke areas (UA and DA) is given by:

$$UA = \sum_{n=0}^{k-1} [f(x_n) - F0_{UP}] \cdot \Delta x, \quad (3)$$

and $$DA = \sum_{n=0}^{k-1} [F0_{DOWN} - f(x_n)] \cdot \Delta x. \quad (4)$$

Figure 14:
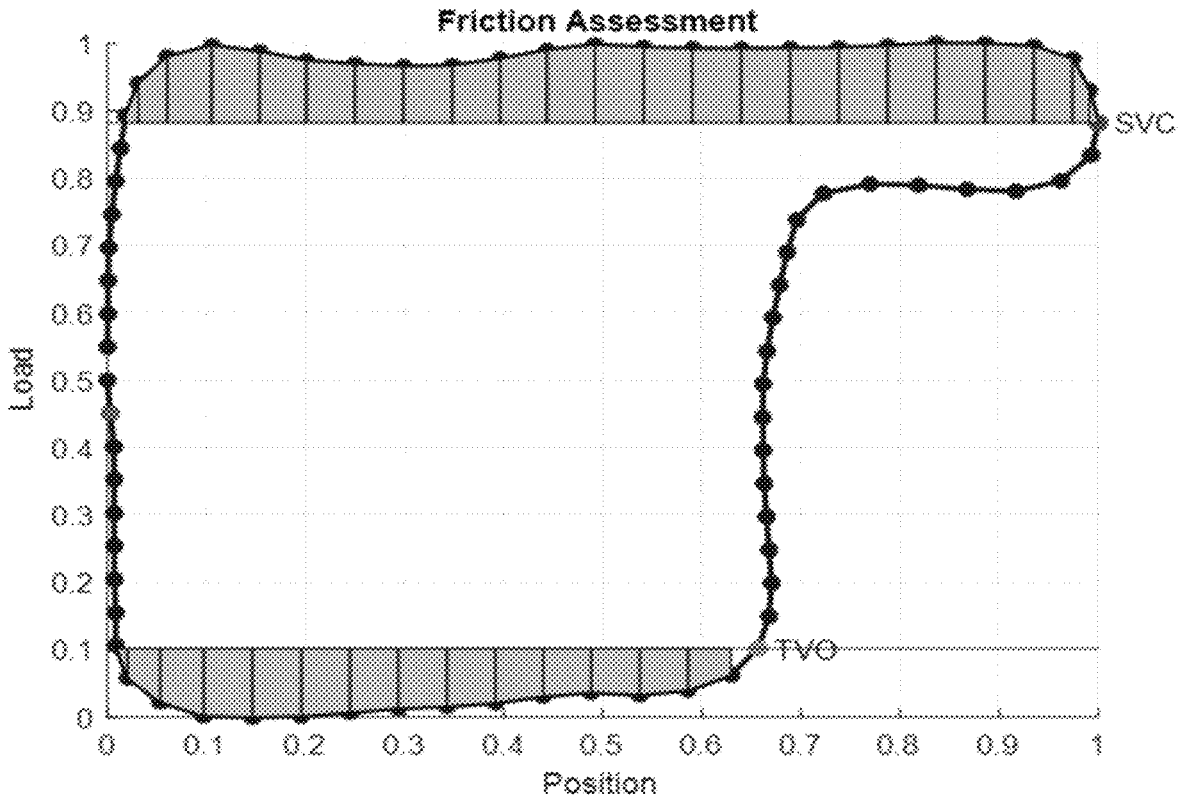
FIG. 14 presents a representation of a friction assessment plotted on a normalized load and position graph using determinations of pump events obtained with the methods of FIG. 2.

The upstroke and downstroke areas are illustrated in the shaded areas within the graph presented in FIG. 14. The upstroke area (UA) is the shaded area at the top of the graph that generally extends between the standing valve opening (SVO) and standing valve closing (SVC) events. The downstroke area (DA) is the shaded area at the bottom of the graph that generally extends between the traveling valve opening (TVO) and the traveling valve closing (TVC) events. The shaded areas generally correspond to potential friction effects within the beam pumping unit 100 system.

Ideally, in the absence of mechanical friction, the pump horsepower should equal the hydraulic horsepower. When the pump horsepower is greater than the hydraulic horsepower, either there is mechanical friction present in the downhole data and/or the viscous damping term of the wave equation did not remove enough energy to compensate for the viscous forces present in the well.

The hydraulic horsepower can be calculated using:

$$HP_{HYD}=7.36\cdot10^{-6}\cdot q\cdot\gamma_L\cdot FL_W. \quad (5)$$

When the pump horsepower is smaller than the hydraulic horsepower, too much energy was removed from the wave equation when calculating downhole data. The method 200 as deployed within the processing unit 162 provides a suggested upstroke damping factor as well as a downstroke damping factor. These damping factors can be used as part of an iterative process. Thus, the method 200 also provides a way of evaluating appropriate viscous damping coefficients and a basis for diagnosing the presence of mechanical friction in the downhole environment.

Thus, as set forth above, the method 200 includes a variety of analytical routines based on both the direct evaluation of the polar coordinate data sets of the position and load measurements made by the sensor module 160 as well as the comparison of the calculated data sets against ideal and reference polar coordinate data sets. It will be appreciated that the method 200 may be practiced using one or more of the various analytical routines outlined above. For example, in some cases, processing unit 162 can be configured to perform some of the analytical routines on a continuous basis until deviations in measurements indicate that additional analytical routines should be conducted. In this way, the processing unit 162 can be optionally configured to autonomously determine which analytical routines should be executed at any given time.

As noted above, the processing unit 162 can also be configured with a connection to the beam pumping unit 100 to automatically adjust the operational parameters of the beam pumping unit 100 based on the output of the method 200. As an example, if the processing unit 162 determines by comparing the polar coordinates for the calculated position and load data against the polar coordinates of reference data sets that the well 145 is pumped off, the processing unit 162 can automatically slow or stop the beam pumping unit 100 to allow the well 145 to replenish with fluids from the surrounding reservoir.

An exemplary use of the method 200 as carried out by the processing unit 162 is presented below. With reference to FIGS. 6-11, portions of the method 200 were applied to several data sets, including a full card data set and a gas interference reference data set. The position and load downhole data are normalized. The normalized downhole card is displayed in FIG. 6. The normalized non-dimensional position data is displayed in FIG. 7. The radius data set is displayed in FIG. 8 and the reference angle data set is displayed in FIG. 9.

Figure 10:
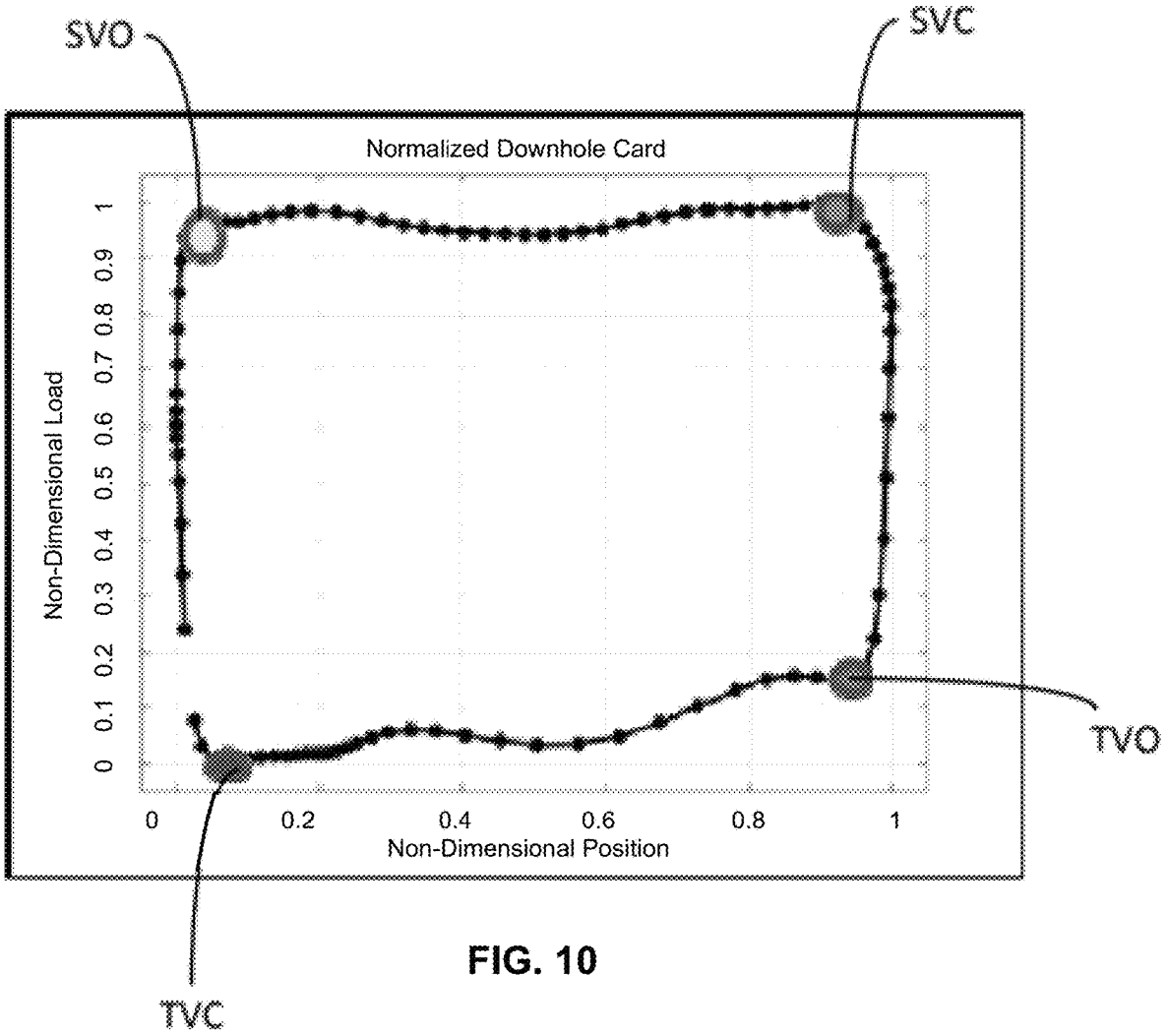
FIG. 10 presents the sample pump card of FIG. 6 with on overlay of the various events determined by analyzing the radius data set.
Figure 11:
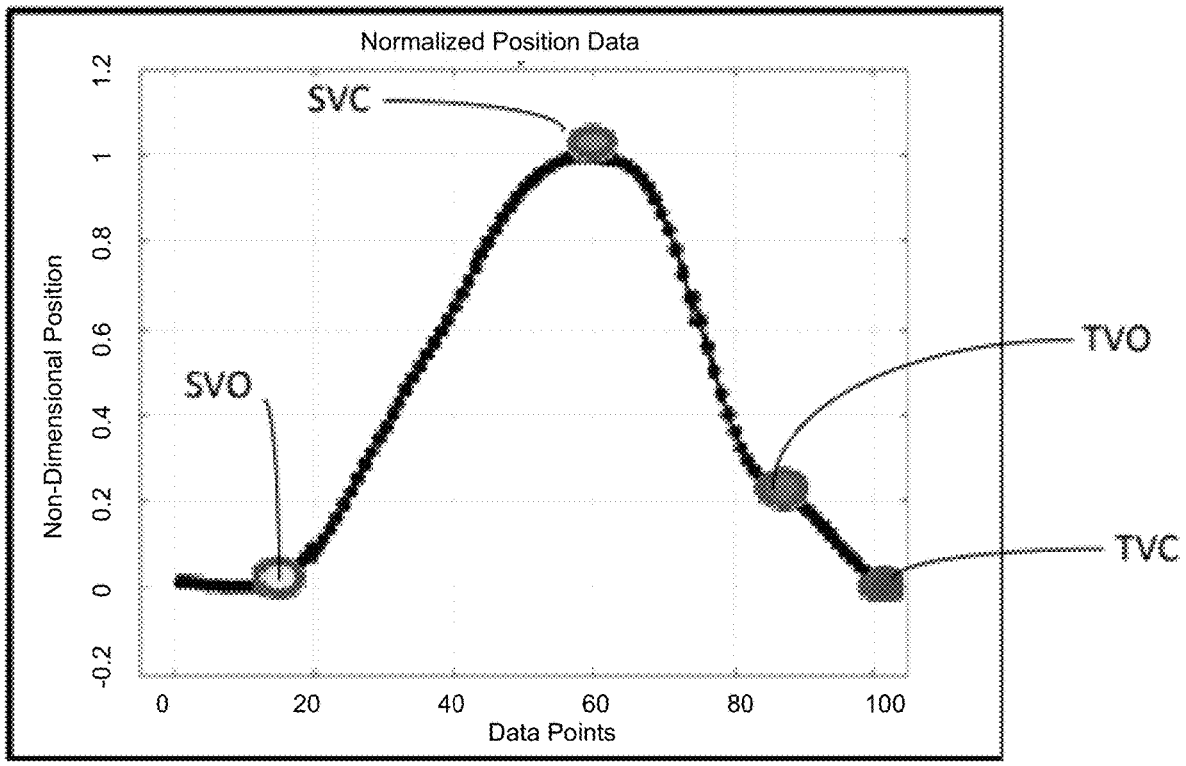
FIG. 11 presents the graphical representation of FIG. 7 with on overlay of the various events determined by analyzing the radius data set.

As indicated in step 212 of the method 200, the radius data set curve is analyzed using first and second derivatives to find the location of the valve openings and closing. The valve closing and opening events are characterized by the local and absolute maximums from the radius data. In this way, the standing valve opening (SVO), standing valve closing (SVC), traveling valve opening (TVO) and traveling valve closing (TVC) are can be determined at steps 212 and 214 based on the polar coordinate data set graphed in FIG. 8. Once the processing unit 162 has identified the points whose polar coordinates correspond to the valve opening and closing events, using the same index, the non-dimensional coordinates for that same point can be multiplied by the downhole position and load spans respectively to yield the original downhole data point corresponding to the valve opening or closing, or correlated to the normalized position and load data that was used to produce the polar data sets (as indicated in FIGS. 10 and 11).

For the full card example, the polar coordinates of the SVO are (0.65, 138°), the non-dimensional coordinates of the SVO are (0.021876, 0.961367) which corresponds to the point (4.6499, 4305). The polar coordinates of the SVC are (0.66, 39°), the non-dimensional coordinates of the SVC or TOS are (1, 0.82) which corresponds to the point (212.56, 3671.96). The polar coordinates of the TVO are (0.55, 329°), the non-dimensional coordinates of the TVO are (0.963822, 0.171952) which corresponds to the point (204.87, 770.001). The polar coordinates of the TVC are (0.66, 228°), the non-dimensional coordinates of the TVC are (0.064452, 0) which corresponds to the point (13.6999, 0).

Figure 12:
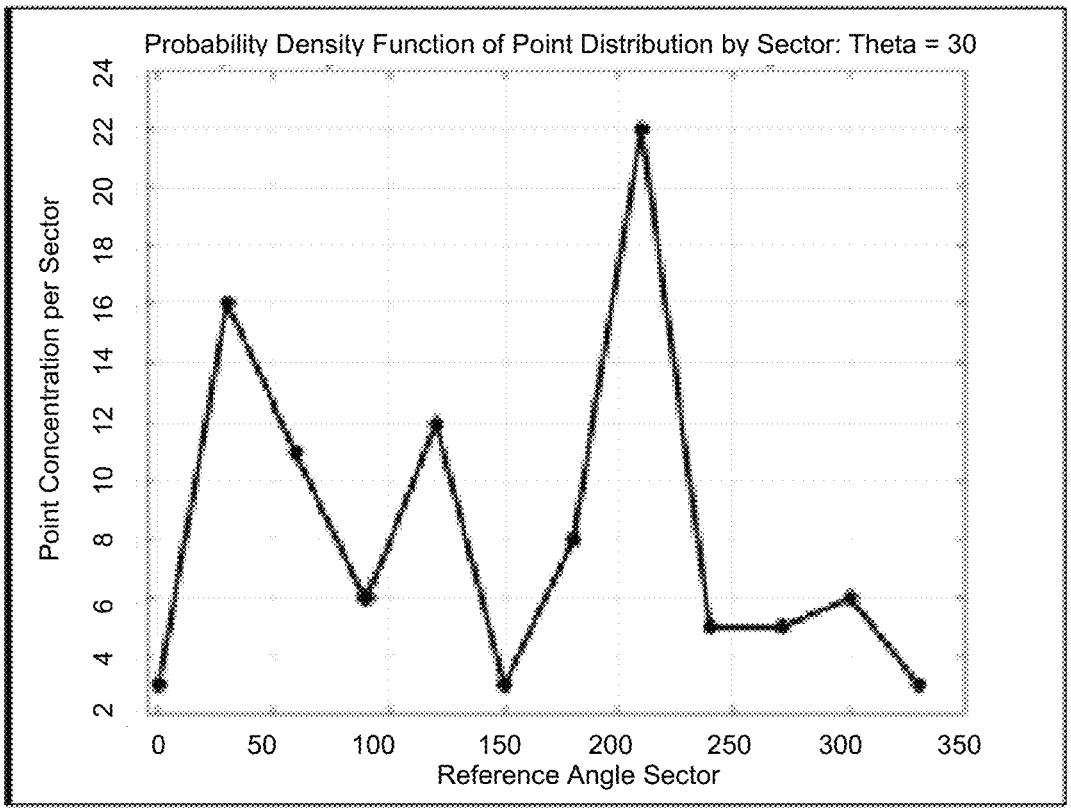
FIG. 12 presents a graphical representation of a coarse-level probability density function derived from the reference angle data set of FIG. 9.
Figure 13:
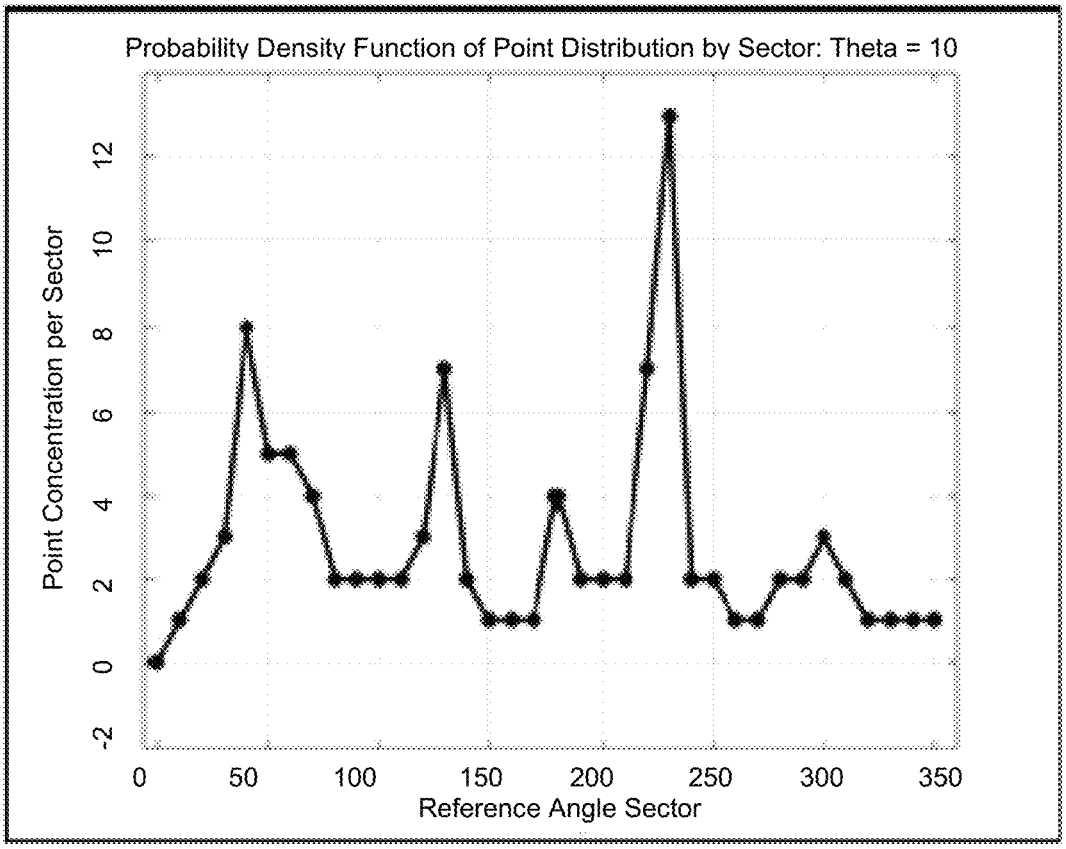
FIG. 13 presents a graphical representation of a fine-level probability density function derived from the reference angle data set of FIG. 9.

The location of the openings and closing can then be verified using the reference angle (step 216 and FIG. 9) and probability density function (steps 218 and 220 and FIGS. 12 and 13) of the point distribution per sector. The sector increment can be increased or decreased for finer analysis. The linear behavior of the points between the SVC and TVO can be analyzed to calculated pump fillage using statistics or other methods. In this full card example, the normalized position values between TOS and TVO can be averaged to give a pump fillage value of 98.95%.

The $F0_{up}$ line is set at the SVC/TOS at 3671 lbs, while $F0_{down}$ line is set at the TVO at 770 lbs. The calculated fluid load for the full card example is 2901 lbs. Furthermore, the area between the upstroke points and $F0_{up}$ can be calculated, using Riemann sums or other method, to approximate the amount of extra friction present or to assess the accuracy of the viscous damping. The results of this example are presented in the table below:

| FULL CARD EXAMPLE | $R_C$ | $\theta_C$ | Norm. Pos. | Norm. Load | Position | Load |
|---|---|---|---|---|---|---|
| SVO | 0.65 | 138° | 0.0218 | 0.961 | 4.649 | 4305.001 |
| SVC | 0.99 | 39° | 1 | 0.82 | 212.56 | 3671.96 |
| TVO | 0.55 | 329° | 0.963 | 0.171 | 204.870 | 770.001 |
| TVC | 0.66 | 228° | 0.064 | 0 | 13.699 | 0 |
| PF | | | | 0.989517 | | |
| F0up | | | | 3671 | | |
| F0down | | | | 770 | | |
| F0 | | | | 2901 | | |

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, although the analytical methods disclosed herein have been applied to data from a downhole reciprocating pump, it will be appreciated that the methods can also be applied to other systems, applications and environments. The analytical methods of the present invention may be applied, for example, to motor controls and control valve operation. It will be appreciated by those skilled in the art that the teachings of the present invention can be applied to other systems without departing from the scope and spirit of the present invention.

What is claimed is:

1. A method for evaluating data from a reciprocating pump driven by a surface-based beam pumping unit, the method comprising the steps of:

acquiring downhole position and load data;

providing the position and load data to a processing unit;

normalizing the position and load data;

converting the normalized position and load data to a calculated polar coordinate data set;

evaluating the calculated polar coordinate data set to determine downhole conditions or occurrences at the reciprocating pump;

outputting calculated key control parameters inferred from the downhole conditions or occurrences for the control and optimization of the reciprocating pump and beam pumping unit; and controlling the beam pumping unit based in part on the determined downhole conditions or occurrences and the calculated key control parameters.

2. The method of claim 1, wherein the step of evaluating the calculated polar coordinate data set further comprises:

determining an occurrence at the reciprocating pump, where the occurrence is selected from the group consisting of standing valve opening, traveling valve closing, traveling valve opening and standing valve closing; and inferring from the determined occurrence at the reciprocating pump the key control parameters.

3. The method of claim 1, further comprising the step of creating a library of ideal and reference data sets, wherein each of the ideal and reference data sets corresponds to polar coordinate data for a known condition for the reciprocating pump.

4. The method of claim 3, further comprising the steps of:

comparing the calculated polar coordinate data set against the library of ideal and reference data sets;

identifying one or more ideal or reference data sets that match one or more portions of the calculated polar coordinate data set; and outputting one or more statements regarding the probability of the presence of one or more of the known conditions within the calculated polar coordinate data set.

5. The method of claim 1, comprising the further step of performing a friction assessment based on the evaluation of the calculated polar coordinate data set.

6. A method for automatically evaluating data from a reciprocating pump driven by a surface-based beam pumping unit that includes a computerized processing unit, the method comprising the steps of:

accessing a library of ideal and reference data sets with the processing unit, wherein each of the ideal and reference data sets corresponds to polar coordinate data for a known condition for the reciprocating pump;

acquiring downhole position and load data;

providing the position and load data to the processing unit;

normalizing the position and load data with the processing unit;

converting the normalized position and load data to a calculated polar coordinate data set with the processing unit;

comparing the calculated polar coordinate data set against the library of ideal and reference data sets with the processing unit;

identifying within the processing unit one or more ideal or reference data sets that match one or more portions of the calculated polar data set;

outputting from the processing unit one or more statements regarding the probability of the presence of one or more of the known conditions within the calculated polar data set;

calculating a key control parameter for the operation of the surface-based beam pumping unit based on the one or more statements regarding the probability of the presence of one or more known conditions within the calculated polar data set; and automatically adjusting operation of the surface-based beam pumping unit using the calculated key control parameter.

7. A method for determining a downhole condition of a reciprocating pump in a well that is driven by a surface-based beam pumping unit, the method comprising the steps of:

acquiring downhole position and load data for the reciprocating pump;

providing the position and load data to a processing unit;

normalizing the position and load data;

converting the normalized position and load data to a calculated polar coordinate data set;

evaluating the calculated polar coordinate data set to determine the downhole condition of the reciprocating pump; and automatically adjusting the performance of the reciprocating pump by adjusting operation of the beam pumping unit with control signals automatically output from the processing unit that are based on the downhole condition of the reciprocating pump.

8. The method of claim 7, further comprising the step of outputting the downhole condition of the reciprocating pump from the processing unit in a format suitable for examination by a human operator.

9. The method of claim 7, wherein the step of evaluating the calculated polar coordinate data to determine the downhole condition of the reciprocating pump further comprises determining an occurrence at the reciprocating pump, where the occurrence is selected from the group consisting of standing valve opening, traveling valve closing, traveling valve opening and standing valve closing.

10. The method of claim 7, wherein the step of converting the normalized position and load data to a calculated polar coordinate data set further comprises overlaying a polar coordinate system onto a graph of the normalized position and load data such that the center of the polar coordinate system is positioned in approximately the center of the graph of the normalized position and load data.

11. The method of claim 10, wherein the step of converting the normalized position and load data to a calculated polar coordinate data set further comprises:

making a radius data set by determining a radial distance between the center of the polar coordinate system and each point in the normalized position and load data set; and making a reference angle set by determining a reference angle from a horizontal line extending through the center of the polar coordinate system to each point in the normalized position and load data set.

12. The method of claim 11, wherein the step of evaluating the calculated polar coordinate data set to determine the downhole condition of the reciprocating pump further comprises:

determining local and absolute maximums of the radius data set; and correlating the local and absolute maximums of the radius data set with an event selected from the group consisting of standing valve opening (SVO), standing valve closing (SVC), traveling valve opening (TVO), and traveling valve closing (TVC).

13. The method of claim 12, wherein the step of determining local and absolute maximums of the radius data set further comprises finding first and second derivatives of the radius data set to identify inflection points within the radius data set that indicate local and absolute maximums within the radius data set.

14. The method of claim 13, wherein the step of evaluating the calculated polar coordinate data set to determine the downhole condition of the reciprocating pump further comprises using the reference angle data set to create a probability density function to determine changes in a instantaneous speed of the reciprocating pump during a pumping cycle.

15. The method of claim 14, wherein the step of evaluating the calculated polar coordinate data set to determine the downhole condition of the reciprocating pump further comprises using the reference angle data set to create a probability density function to identify a source of mechanical friction caused by the movement of the reciprocating pump within the well.

16. The method of claim 15, wherein the step of evaluating the calculated polar coordinate data set to determine the downhole condition of the reciprocating pump further comprises evaluating the calculated coordinate data set to determine the extent of pump fillage.

* * * * *